US006431322B1

(12) United States Patent
Rossman et al.

(10) Patent No.: US 6,431,322 B1
(45) Date of Patent: Aug. 13, 2002

(54) PLUNGER GUIDE FOR A TELESCOPIC JACK IN A HYDRAULIC ELEVATOR

(75) Inventors: Eileen W. Rossman, Carlisle; Karl B. Orndorff, Gettsburg, both of PA (US)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/629,755

(22) Filed: Jul. 31, 2000

(51) Int. Cl.[7] ..... B66B 9/04
(52) U.S. Cl. ..... 187/272; 187/406; 187/409
(58) Field of Search ..... 187/272, 273, 187/406, 409, 410

(56) References Cited

U.S. PATENT DOCUMENTS 5,361,874 A 11/1994 Brown
6,012,554 A * 1/2000 Ito et al. ..... 187/406

FOREIGN PATENT DOCUMENTS

AT 272 010 6/1969
JP 080 67 463 3/1996
SE 318385 * 12/1969

* cited by examiner

*Primary Examiner*—Thomas J. Brahan
(74) *Attorney, Agent, or Firm*—Cohen, Pontani, Lieberman & Pavane

(57) ABSTRACT

A plunger guide for a telescopic jack in a hydraulic elevator includes a crenelated guide rail with a top surface, two opposing side surfaces which are perpendicular to the top surface, and first and second flanged projections respectively projecting from the first and second side surfaces. The plunger guide also includes a support having a bracket and a lateral segment which connects the bracket to the plunger to be guided. The bracket includes a first set of bearings arranged for gliding on the top surface of the guide rail, a second set of bearings for gliding on both side surfaces of the guide rail, and a third set of bearings for gliding on a bottom surface of each of the first and second flanged projections which faces away from the top surface.

19 Claims, 6 Drawing Sheets

PLUNGER GUIDE FOR A TELESCOPIC JACK IN A HYDRAULIC ELEVATOR

BACKGROUND OF THE INVENTION

1. Field of the Invention

The present invention relates to a plunger guide for a telescopic jack in a hydraulic elevator.

2. Description of the Related Art

A conventional hydraulic elevator comprises a telescopic jack including a plunger for raising and lowering an elevator car. An example of this type of elevator is disclosed in Austrian Patent No. 272010. FIG. 7 of the present application is a schematic view of a conventional hydraulic elevator arrangement 1 comprising a telescopic hydraulic plunger 10 including a cylinder 12, a first telescopic piston 14, and a second telescopic piston 16. The cylinder 12 is attached to the elevator car 18 which is held between two guide rails 20, 22. The second telescopic piston 16 is supported via a support on the ground or floor beneath the elevator. In addition, the first telescopic piston is supported between the two guide rails by support yokes 24, 26 to ensure that the first telescopic piston 14 maintains its alignment with the cylinder 12 and the second telescopic piston 16 of the hydraulic plunger 10. FIG. 8 is a detailed view of the connection between the support yoke 26 and rail 22. A bracket 28 is arranged at the end of the support yoke 26 and comprises a first set of bearings 30 which slide on the top of the rail 22 and prevent the support yoke 26 from moving toward the rail 22. A second set of bearings 32 is arranged on the bracket 28 to slide on the sides of the rail 22 and prevent the support yoke 26 from moving off of either side of the rail 22. However, the opposing rail 20 and support yoke 24 are required to prevent the support yoke 26 from moving away from the rail 22.

Accordingly, both guide rails 20 and 22 are required for maintaining the alignment of the telescopic hydraulic plunger 10. The guide rails may simultaneously provide guidance for both the plunger 10 and the elevator car 110. In some cases dual telescopic jacks are arranged on opposing sides of the elevator cars are used to lift hydraulic elevators. In this case, at least one additional guide rail is required to provide guidance for each of the individual telescopic jacks.

SUMMARY OF THE INVENTION

It is an object of the present invention to provide a plunger guide for a plunger of a hydraulic jack in a hydraulic elevator which requires only a single guide rail.

The object of the present invention is achieved by a plunger guide for a telescopic jack in a hydraulic elevator comprising a crenelated guide rail comprising a top surface, first and second opposing sides surfaces arranged substantially perpendicular to the top surface, and first and second flanged projections arranged on said first and second side surfaces. The first and second flanged projections are substantially parallel to said top surface. The plunger guide also includes a plunger guide support comprising a bracket glidably arranged on the crenelated guide rail and a lateral segment connected to the bracket. The lateral segment is connectable to the telescopic jack for guiding the telescopic jack along the crenelated guide rail. The bracket includes a first set of bearings arranged for gliding on the top surface, a second set of bearings comprising at least one bearing arranged for gliding along the first side surface and at least one bearing arranged for gliding along the second surface, and a third set of bearings arranged for gliding on a side of the first and second flanged projections which faces away from the top surface.

The object of the present invention is also achieved by providing a plunger guide for a telescopic jack in a hydraulic elevator comprising a crenelated guide rail comprising a top surface, first and second sides surfaces arranged substantially perpendicular to the top surface, and a third and fourth flanged projections respectively projecting from the first and second side surfaces and arranged substantially parallel to the top surface. The plunger guide further comprises first and second flanged projections respectively projecting from each of the first and second side surfaces and arranged substantially parallel to the top surface. The first flanged projection is fixedly arranged against the first side surface of the crenelated guide rail between the third flanged projection and the top surface and the second flanged projection is fixedly arranged against the second side surface between the fourth flanged projection and the top surface. A plunger guide support comprising a bracket is glidably arranged on the crenelated guide rail. The plunger guide support further comprises a lateral segment connected to the bracket. The lateral segment is connectable to the telescopic jack for guiding the telescopic jack along the crenelated guide rail. The bracket includes a first set of bearings arranged for gliding on the top surface, a second set of bearings comprising at least one bearing arranged for gliding along each one of the first and second side surfaces, and a third set of bearings arranged for gliding on sides of the first and second flanged projections which face away from the top surface.

In another embodiment, the object of the present invention is met by providing a plunger guide support for a telescopic jack in a hydraulic elevator glidably arrangeable on a crenelated guide rail which comprises a top surface, first and second opposing sides surfaces arranged substantially perpendicular to the top surface, and first and second flanged projections arranged on the first and second side surfaces, the first and second flanged projections being substantially parallel to said top surface. The plunger guide support according to the present invention comprises a bracket and a lateral segment connected to the bracket. The lateral segment is connectable to the telescopic jack for guiding the telescopic jack along the crenelated guide rail. The bracket includes a first set of bearings arranged for gliding on the top surface of the crenelated guide rail, a second set of bearings comprising at least one bearing arranged for gliding along each one of said first and second side surfaces of the crenelated guide rail, and a third set of bearings arranged for gliding on sides of the first and second flanged projections which face away from said top surface.

A conventional crenelated guide rail may be utilized with a guide angle fixedly connected thereon for forming the first flanged portion projecting from the side surfaces. The guide angle may comprise an L-shaped angle or a U-shaped angle.

Furthermore, the bracket of the plunger guide may comprise a conventional bracket that is typically used with the conventional crenelated guide rail. Additional clip portions are added onto the conventional bracket with bearings which are arranged such that they wrap around the first flanged portion and comprise bearing arranged to glide against the back side of the first flanged portion, i.e., the side of the first flanged portion facing away from the top surface. Accordingly, existing parts may be utilized with minor modifications to achieve the present invention.

Of course, both the guide rail and the plunger guide according to the present invention could also be manufactured as integral pieces instead of adding subcomponents to the known rails and brackets.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements through the several views.

DETAILED DESCRIPTION OF THE PRESENTLY PREFERRED EMBODIMENTS

Figure 1:
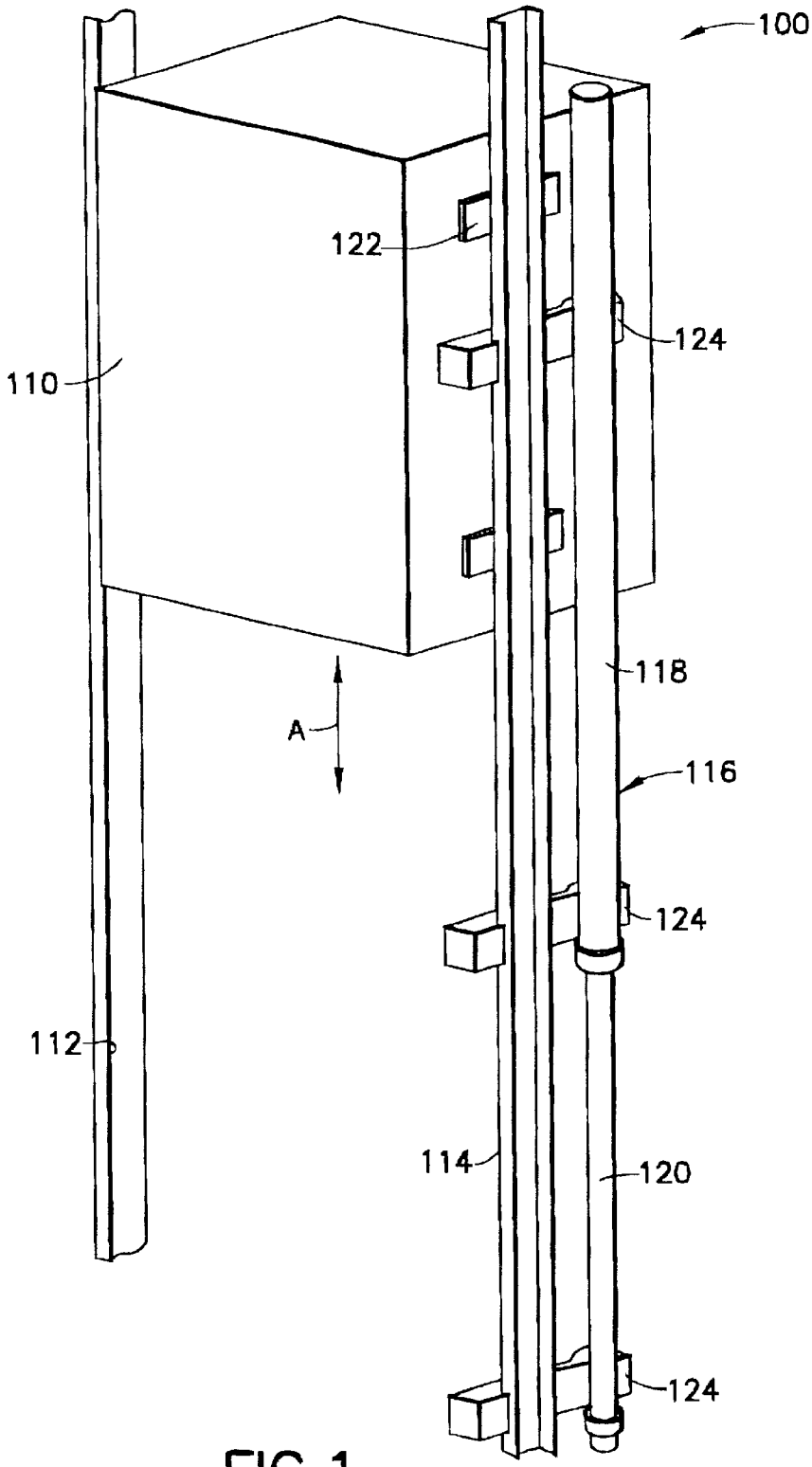
FIG. 1 is a perspective view of an elevator installation with a telescopic plunger according to an embodiment of the present invention.

FIG. 1 is a perspective view of a hydraulic elevator 100 according to an embodiment of the present invention comprising an elevator car 110 and two guide rails 112, 114. A telescopic plunger 116 is arranged on a side of the elevator car 110 and includes a cylinder 118 and a first telescopic piston 120. The cylinder 118 is fixedly connected to the elevator car 110 and supports the elevator car. The telescopic jack also includes a reservoir of hydraulic fluid and a system for controlling the hydraulic fluid in the plunger 116 for raising and lowering the elevator 110 which are not shown in FIG. 1. The telescopic plunger 116 is held in alignment by guide supports 124 which are arranged between the telescopic plunger 116 and the guide rail 114 to keep the various sections of the telescopic plunger 116 in alignment. The elevator car 110 itself may be supported against the guide rails via supports 122. Alternatively, the elevator car 110 may be guided via the connection to the cylinder 118 which, in turn, is supported on one of the guide rails via guide supports 124. The plunger 116 may comprise the plunger as disclosed in U.S. patent application Ser. No. 09/301,170, filed Apr. 28, 1999, the entire contents of which are incorporated herein by reference.

Figure 2:
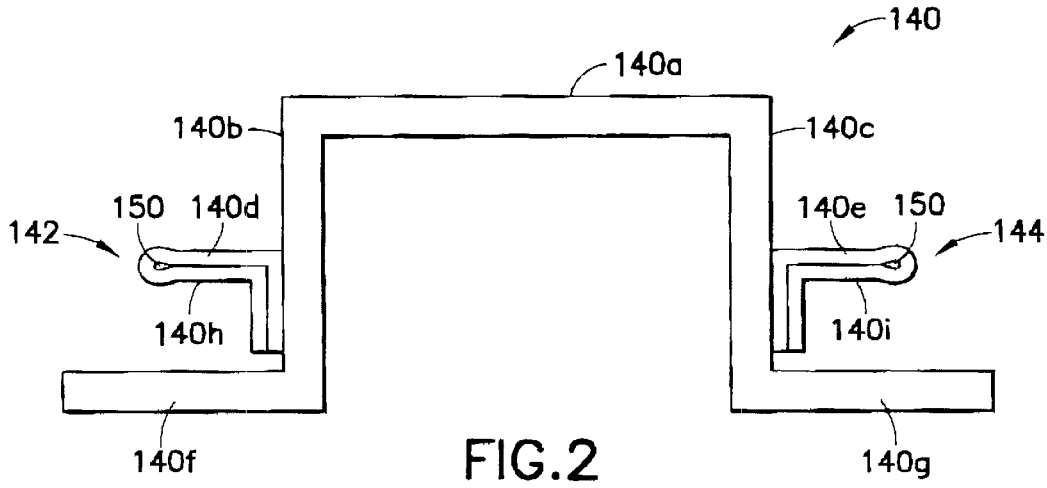
FIG. 2 is a sectional view of a guide rail according to the embodiment of the present invention shown in FIG. 1.
Figure 2A:
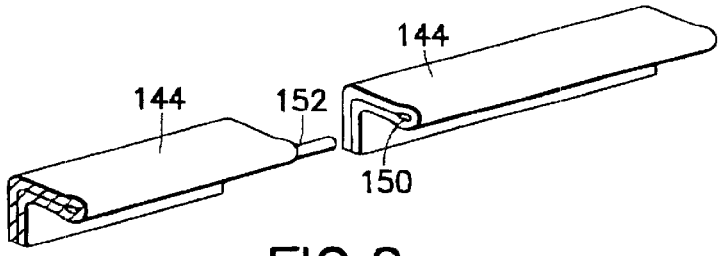
FIG. 2*a* is a detailed perspective view showing the connection of a two-section guide angle in which two longitudinal ends are aligned.

Each of the guide rails 112, 114 comprises a crenelated guide rail 140 as shown in FIG. 2. Each crenelated guide rail 140 comprises a top surface 140*a*, first and second side surfaces 140*b*, 140*c* which are substantially perpendicular to the top surface 140*a*, first and second flanged projections 140*d*, 140*e*, and third and fourth flanged projections 140*f*, 140*g*. Each of the first, second, third, and fourth flanged projections 140*d*, 140*e*, 140*f*, 140*g* is substantially parallel to the top surface 140*a*. The third and fourth flanged projections 140*f*, 140*g* typically have holes therethrough and are used for anchoring the crenelated guide rail 140 to a wall or other vertical support. The first and second flanged projections 140*d*, 140*e* are formed using first and second guide angles 142, 144, referred to as jack guide angles. Each guide angle 142, 144 comprises an L-shaped angle with one leg bolted onto a respective one of the first and second side surfaces 140*b*, 140*c* of the crenelated guide rail 140 and another leg projecting from the respective one of the first and second side surfaces 140*b*, 140*c* of the crenelated guide rail 140. Although the guide angles 142, 144 are bolted onto the crenelated guide rail 140 in the preferred embodiment, they may be fixedly connected to the crenelated guide rails via any other means including, for example, riveting or welding. Each of the first and second guide angles 142, 144 comprises a thin sheet of material which is bent over to obtain a double thickness. This arrangement is known as a "hemmed" angle. The result of this arrangement is that the guide angle comprises a teardrop-shaped gap 150 at the crease, i.e., the folded end, of the "hemmed" angle. The legs of the guide angles comprising the gap 150 are the first and second flanged projections 140*d*, 140*e*. When two guide angles are arranged end to end on one crenelated guide rail, a small spline 152 may be used to fit into the gap 150 in the lower and the upper guide angles for alignment (see FIG. 2*a*). Furthermore, the projecting crease or folded end is smooth and will not cut an installer.

Figure 2B:
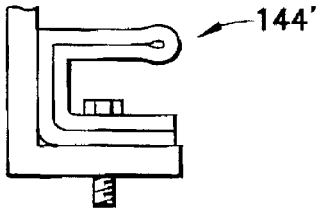
FIG. 2*b* is a detailed view of a guide angle for a guide rail according to a further embodiment of the present invention.

Instead of L-shaped angles, the first and second guide angles 142, 144 may comprise u-shaped angles having a bottom leg and two side legs, wherein one of the two side legs may be arranged against the third and fourth flanged projections and bolted thereto using the pre-existing holes in the third and fourth flanged projections which are used for anchoring the crenelated guide rail to a wall or other support (see guide angle 144' in FIG. 2*b*).

Figure 4:
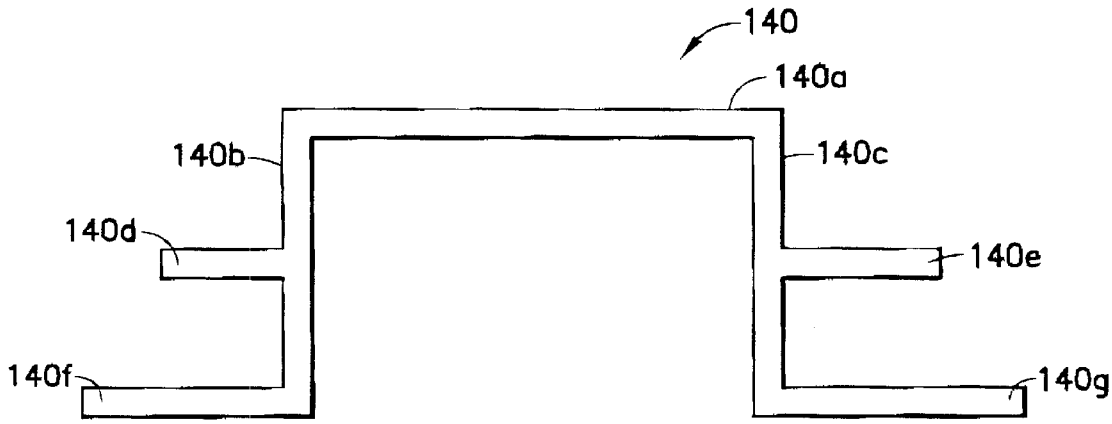
FIG. 4 is a sectional view of another embodiment of a guide rail according to the present invention.
Figure 5:
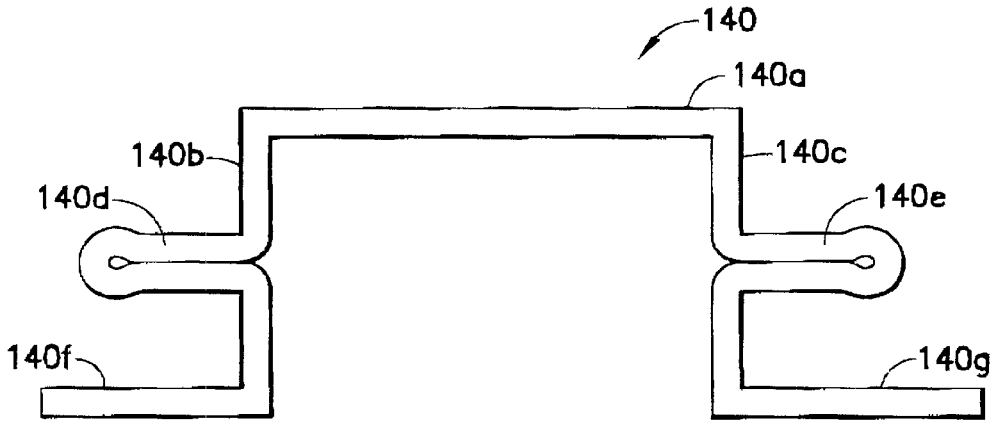
FIG. 5 is a sectional view of another embodiment of a guide rail according to the present invention.

Although the first and second flanged projections 140*d*, 140*e* comprise first and second guide angles 142, 144, angles which are bolted onto the guide rails 140 in the preferred embodiment, the first and second flanged projections 140*d*, 140*e* may also comprise part of an extrusion as shown in FIG. 4 in which the entire guide rail 140', including the first and second flanged projections 140*d*', 140*e*', is extruded as one integral part. In a further alternative embodiment shown in FIG. 5, the first and second flanged projections 140*f*", 140*g*" may be formed by bending the sides of the guide rail 140" so that the first and second flanged projections 140*f*", 140*g*" are double layered and have a gap 150" at the crease.

Figure 3:
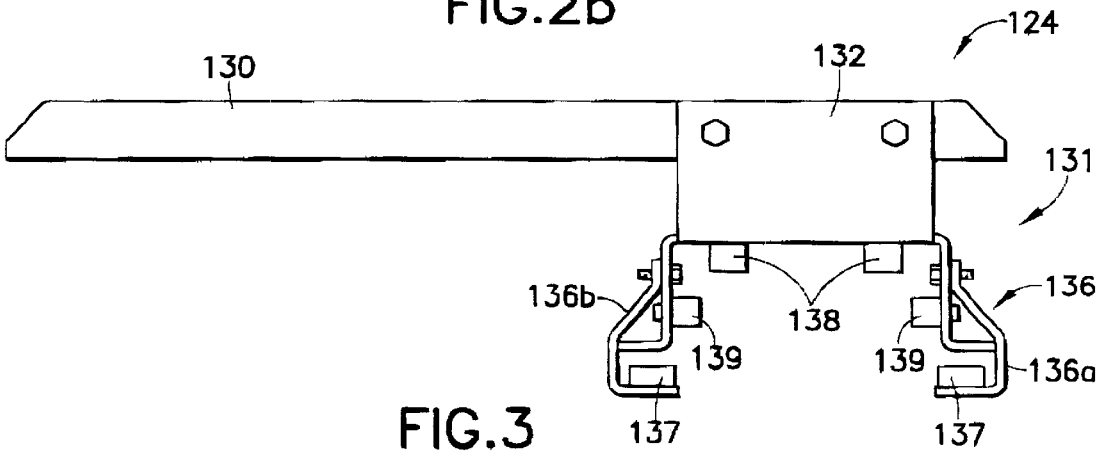
FIG. 3 is a plan view of a plunger guide support according to the embodiment of the present invention shown in FIG. 1.

Each of the plunger guide supports 124 comprises a lateral segment 130 and a bracket assembly 131 comprising a plunger guide bracket 132 and a clip assembly 136 as shown in FIG. 3. One end of the lateral segment 130 is connected to the plunger guide bracket 132 and the lateral segment 130 comprises a connection to the plunger 116 proximate the other end of the lateral segment 130 (see FIG. 1). The connection to the plunger may comprise threaded connectors, welding, riveting, or any other type of connector which provides adequate support. The plunger guide bracket 132 includes bearings 138 arranged for facing the top surface 140*a* of the crenelated guide rails 140 and bearings 139 arranged for facing the first and second side surfaces 140*b*, 140*c* of the crenelated guide rail 140. Furthermore, the clip assembly 136 comprises first and second clip portions 136*a*, 136*b* which are arranged on the plunger guide bracket 132. The first and second clip portions 136*a*, 136*b* have support bearings 137 which are arranged so that they face the bearings 138. When the bracket assembly 131 is arranged on the guide rail 140, the support bearings 137 face the bottom surfaces 140*h*, 140*i* of the first and second flanged projection 140*d*, 140*e*, which face away from the top surface 140*a*. The plunger guide bracket 132 may comprise a conventional bracket used for crenelated rails with the first and second clip portions 136*a*, 136*b* of the bracket assembly 131 fixedly connected thereto as shown in FIG. 3. Alternatively, the plunger guide bracket 132 and the first and second clip portions 136*a*, 136*b* may comprise an integral element. The bearings 137, 138, 139 preferably comprise nylon or Ultra High Molecular Weight (UHMW) polymer spacers. Alternatively, the bearings 137, 138, 139 may comprise any known bearing materials or components which may be used for gliding against the guide rail 140.

Figure 6:
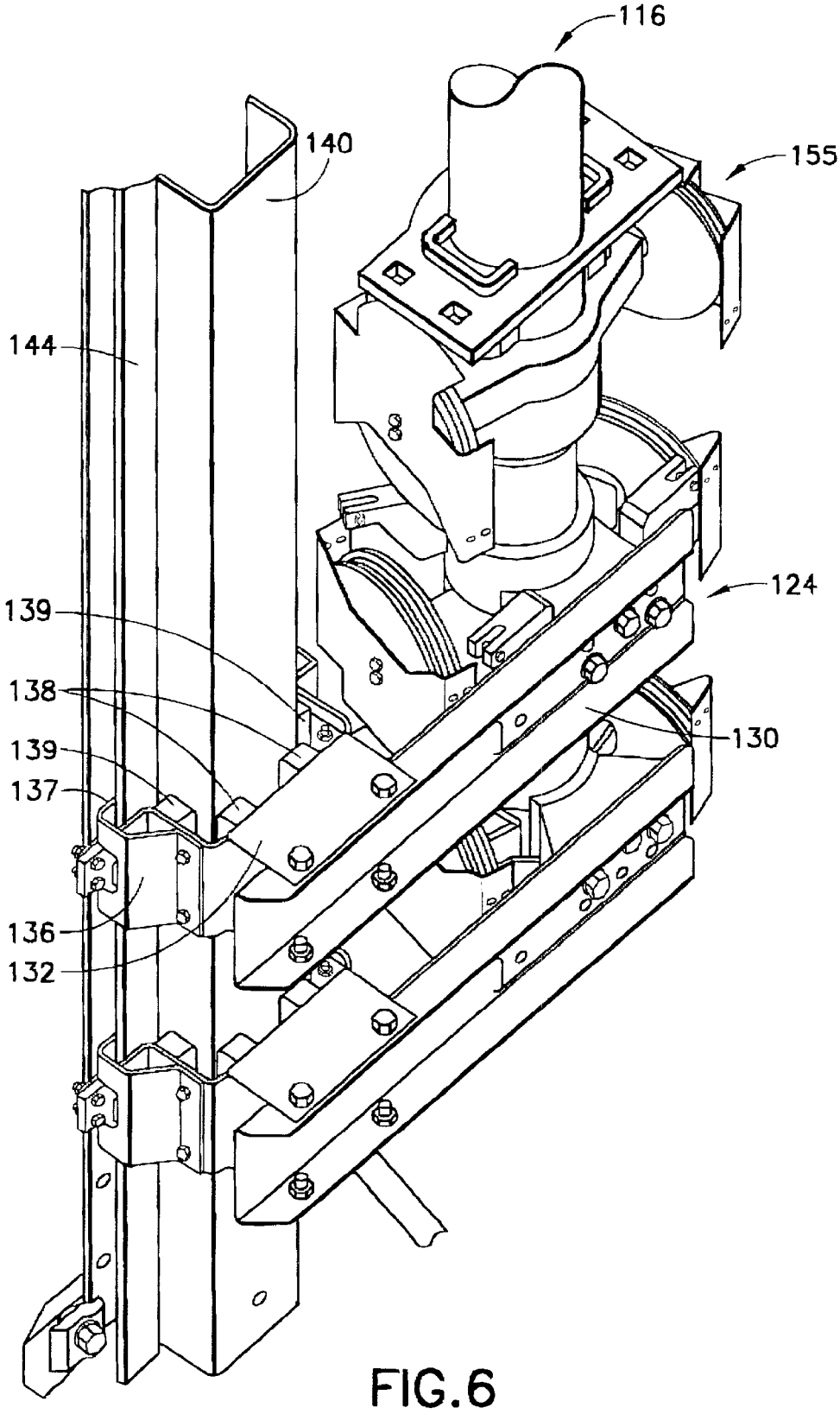
FIG. 6 is a perspective view of the plunger guide support of FIG. 3 arranged on the guide rail of FIG. 2.
Figure 7:
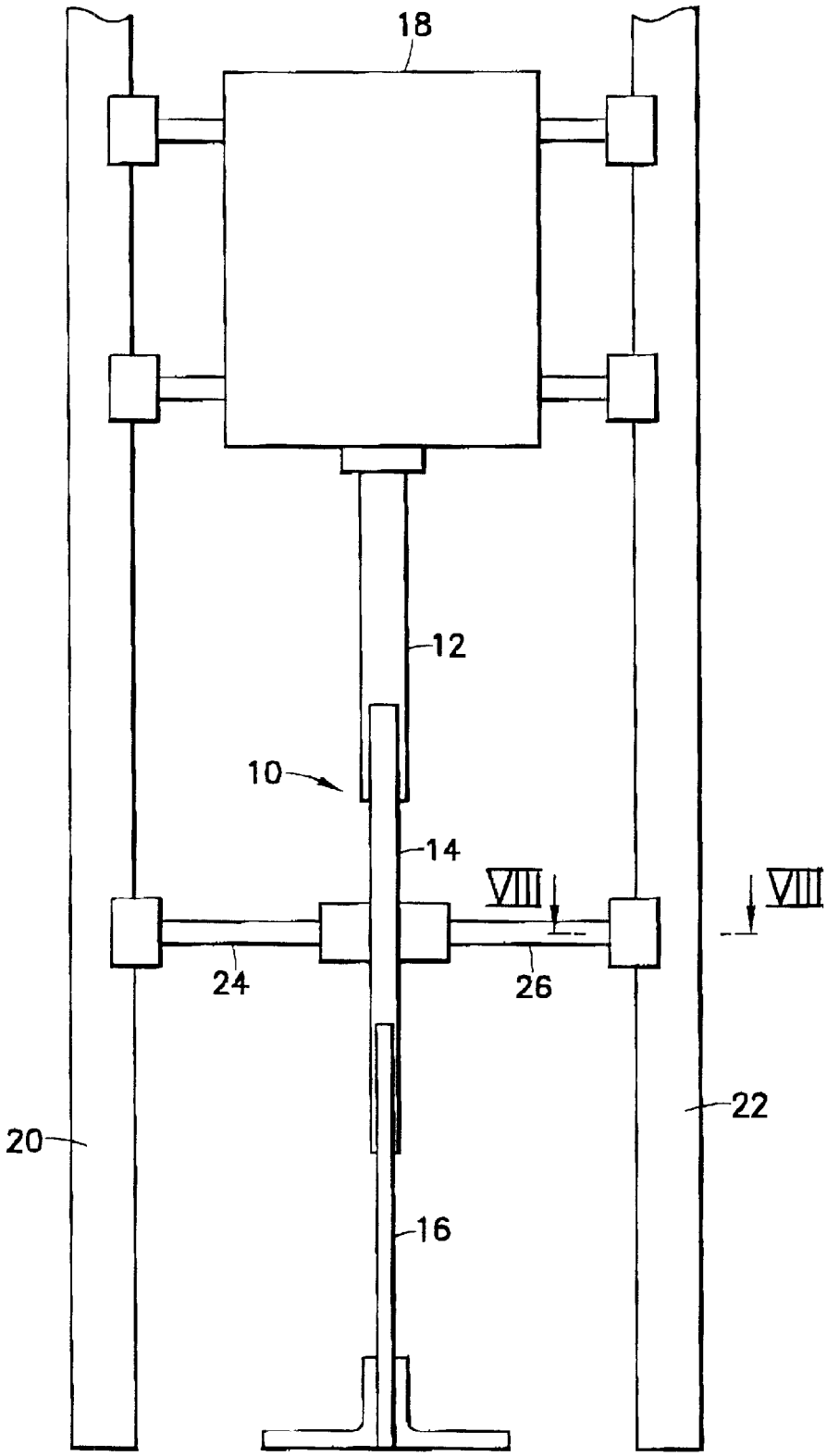
FIG.7 PRIOR ART
FIG. 7 is a schematic diagram showing a conventional hydraulic elevator jack according to the prior art.
Figure 8:
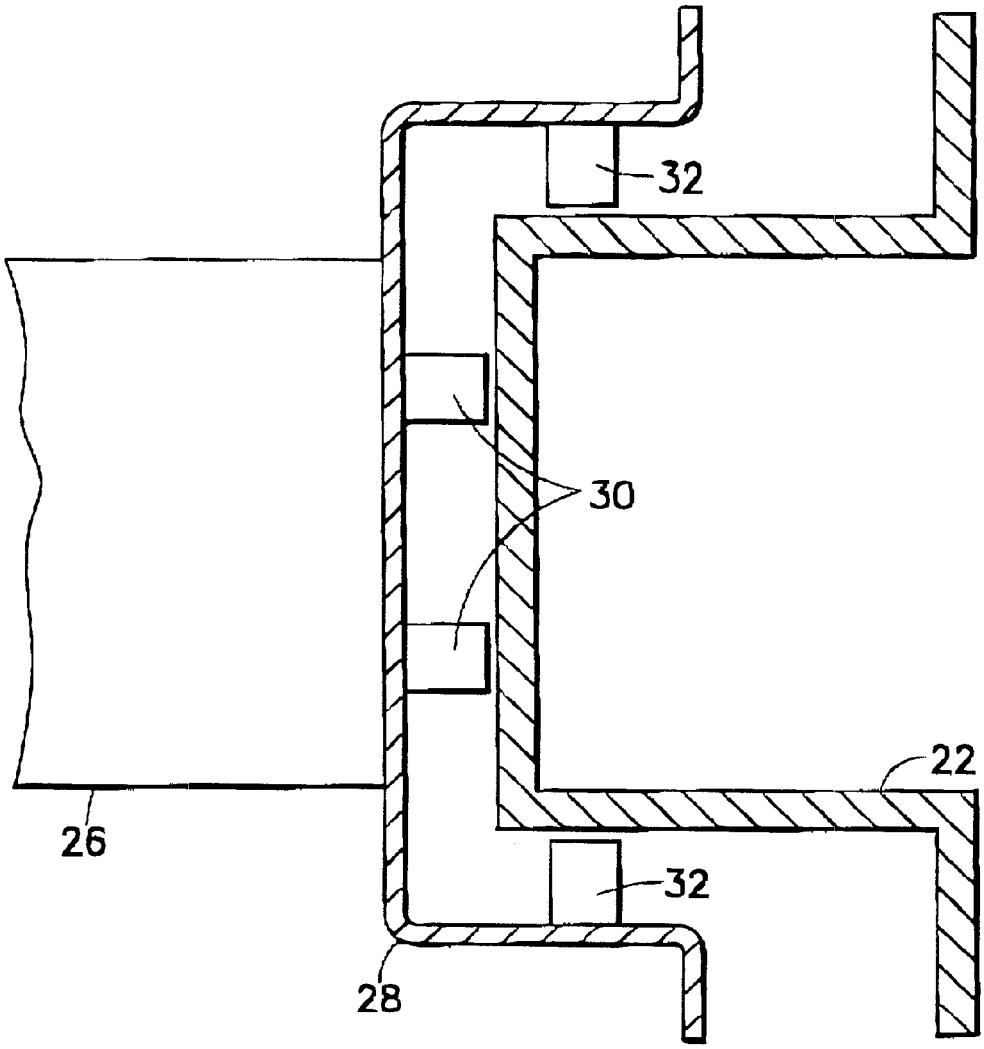
FIG.8 PRIOR ART
FIG. 8 is a sectional view of the conventional guide rail and plunger guide support along line VII–VIII of FIG. 7.

FIG. 6 shows the plunger guides 124 arranged on a guide rail 142. The bearings 138 prevent the plunger guide 124 from moving toward the guide rail 142, the bearings 139 prevent the plunger guide 124 from moving toward either side of the guide rail 142, and the bearings 137 prevent the plunger guide 124 from moving away from the top surface 140*a* of the guide rail 142. Accordingly, a plunger 116 connected to the lateral segment 130 is held in a defined location relative to the longitudinal axis of the guide rail 142 as the plunger 116 is operated to raise and lower the elevator car 110. The lateral segment 130 may comprise a c-channel for added strength.

The telescopic plunger 116 in FIG. 6 is shown with a synchronization device 155 on each telescopic piston section of the plunger. The synchronization device 155 is described in U.S. patent application Ser. No. 09/301,170, the entire contents of which are incorporated herein by reference. The synchronization device 155 ensures that each telescopic portion of the telescopic plunger 116 is an equal length of withdrawal at any position during travel.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A plunger guide for a telescopic jack in a hydraulic elevator, comprising:

a crenelated guide rail comprising a top surface, first and second opposing side surfaces arranged substantially perpendicular to said top surface, and first and second flanged projections arranged on said first and second side surfaces, said first and second flanged projections being substantially parallel to said top surface and having first and second bottom surfaces facing away from said top surface; and a plunger guide support comprising a bracket assembly glidably arranged on said crenelated guide rail and a lateral segment connected to said bracket, said lateral segment being connectable to the telescopic jack for guiding the telescopic jack along said crenelated guide rail, said bracket including a first set of bearings arranged for gliding on said top surface, a second set of bearings comprising at least one bearing arranged for gliding along said first side surface and at least one bearing arranged for gliding along said second side surface, and a third set of bearings arranged for gliding on said first and second bottom surfaces of said first and second flanged projections.

2. The plunger guide of claim 1, wherein said bracket assembly further comprises a bracket on which said first and second sets of bearings are mounted and two clip portions respectively connected on opposing sides of said bracket, said third set of bearings being arranged on said two clip portions.

3. The plunger guide of claim 1, wherein said lateral segment comprises a C-channel structure.

4. The plunger guide of claim 1, wherein said guide rail comprises third and fourth flanged projections respectively arranged at ends of said first and second side surfaces opposing said top surface such that said first flanged projection is arranged between said top surface and said third flanged projection on said first side surface and said second flanged projection is arranged between said top surface and said fourth flanged projection on said second side surface.

5. The plunger guide of claim 4, further comprising first and second L-shaped angles respectively arranged at said first and second side surfaces, wherein each of said first and second L-shaped angles comprises a first leg and a second leg, wherein said first legs of said first and second L-shaped angles are fixedly connected to said first and second side surfaces and said second legs of said first and second L-shaped angles comprise said first and second flanged projections.

6. The plunger guide of claim 5, wherein each of said first and second L-shaped angles comprises a double layer material including a sheet material folded along an edge to form a crease, wherein said crease is arranged on a distal end of said second leg and forms a gap in said double layer material.

7. The plunger guide of claim 6, wherein one of said first and second L-shaped angles comprises two longitudinal sections having abutting ends, and said plunger guide further comprising a spline inserted into said gap at each of said abutting ends for aligning said two longitudinal sections.

8. The plunger guide of claim 4, further comprising first and second U-shaped angles, each of said U-shaped angles having a bottom end and two side legs, wherein said bottom ends are arranged against said first and second side surfaces, first ones of said two side legs are connected to said third and fourth flanged projections and second ones of said two legs comprise said first and second flanged projections.

9. The plunger guide of claim 4, wherein said first and second flanged projections are integrally formed with said guide rail.

10. The plunger guide of claim 4, wherein each of said first and second flanged projections comprises a double layered projection including a thin sheet material folded along a folded edge to form a crease, and wherein said each of said first and second flanged projections are arranged so that said crease is arranged at a distal end remote from said first and second side surfaces.

11. The plunger guide of claim 10, wherein said each of said first and second flanged projections comprises a teardrop-shaped gap proximate said crease.

12. A plunger guide for a telescopic jack in a hydraulic elevator, comprising:

a crenelated guide rail comprising a top surface, first and second side surfaces arranged substantially perpendicular to said top surface, and third and fourth flanged projections respectively projecting from said first and second side surfaces and arranged substantially parallel to said top surface;

first and second flanged projections respectively projecting from each of said first and second side surfaces and arranged substantially parallel to said top surface, said first flanged projection being fixedly arranged against said first side surfaces of said crenelated guide rail between said third flanged projection and said top surface, and said second flanged projection being arranged against said second side surface between said fourth flanged projection and said top surface, and said first and second flanged projections having first and second bottom surfaces facing away from said top surface; and a plunger guide support comprising a bracket assembly glidably arranged on said crenelated guide rail and a lateral segment connected to said bracket, said lateral segment being connectable to the telescopic jack for guiding the telescopic jack along said crenelated guide rail, said bracket assembly including a first set of bearings arranged for gliding on said top surface, a second set of bearings comprising at least one bearing arranged for gliding along each one of said first and second side surfaces, and a third set of bearings arranged for gliding on said first and second bottom surfaces of said first and second flanged projections.

13. The plunger guide of claim 12, wherein said first and second flanged projections comprise first legs of first and second L-shaped angles arranged at said first and second side surfaces, wherein a second leg of said first and second L-shaped angles is fixedly connected to said each of said first and second side surfaces.

14. The plunger guide of claim 13, wherein said first and second L-shaped angles comprises a double layer material including a sheet material folded along an edge to form a crease, said crease being arranged on the projecting end of said first and second flanged projections, said first and second L-shaped angles comprising a teardrop-shaped gap proximate said crease.

15. The plunger guide of claim 14, wherein one of said first and second L-shaped angles comprises two longitudinal sections having abutting ends, and said plunger guide further comprising a spline inserted into said gap at each of said abutting ends for aligning said two longitudinal sections of said one of said first and second L-shaped angles.

16. The plunger guide of claim 12, wherein said first and second flanged projections comprise first legs of U-shaped angles having bottom ends arranged at said first and second side surfaces, and wherein second legs of said U-shaped angles are connected to said third and fourth flanged projections.

17. A plunger guide support for a telescopic jack in a hydraulic elevator glidably arrangeable on a crenelated guide rail comprising a top surface, first and second opposing sides surfaces arranged substantially perpendicular to the top surface, and first and second flanged projections arranged on the first and second side surfaces, the first and second flanged projections being substantially parallel to said top surface and having first and second bottom surfaces facing away from the top surface, said plunger guide support comprising a bracket assembly and a lateral segment connected to said bracket assembly, said lateral segment being connectable to said telescopic jack for guiding said telescopic jack along the crenelated guide rail, said bracket assembly including a first set of bearings arranged for gliding on the top surface, a second set of bearings comprising at least one bearing arranged for gliding along each one of said first and second side surfaces, and a third set of bearings arranged for gliding on the first and second bottom surfaces of said first and second flanged projections which face away from said top surface.

18. The plunger guide support of claim 17, wherein said bracket assembly further comprises a bracket on which said first and second sets of bearings are arranged and two clip portions respectively connected on opposing sides of said bracket, wherein said third set of bearings are arranged on said two clip portions.

19. The plunger guide support of claim 17, wherein said lateral segment comprises a C-channel structure.

* * * * *